US010520849B2

(12) United States Patent
Shimizu et al.

(10) Patent No.: US 10,520,849 B2
(45) Date of Patent: Dec. 31, 2019

(54) IMAGE FORMING APPARATUS AND CONTROL METHOD THEREOF

(71) Applicant: CANON KABUSHIKI KAISHA, Tokyo (JP)

(72) Inventors: Yusuke Shimizu, Yokohama (JP); Kenichi Iida, Tokyo (JP); Hikaru Osada, Kamakura (JP); Tomoo Akizuki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/247,395

(22) Filed: Jan. 14, 2019

(65) Prior Publication Data

US 2019/0219942 A1 Jul. 18, 2019

(30) Foreign Application Priority Data

Jan. 18, 2018 (JP) ..... 2018-006691

(51) Int. Cl.
*G03G 15/04* (2006.01)
*G03G 15/043* (2006.01)
*G03G 15/041* (2006.01)

(52) U.S. Cl.
CPC ..... *G03G 15/043* (2013.01); *G03G 15/0415* (2013.01)

(58) Field of Classification Search
CPC ..... G03G 15/043; G03G 15/041; G03G 15/0415; B41J 2/47; G02B 26/10
See application file for complete search history.

(56) References Cited

U.S. PATENT DOCUMENTS

| | | | | |
|---|---|---|---|---|
| 7,675,532 | B2 | 3/2010 | Iida et al. | 347/132 |
| 9,319,553 | B2 | 4/2016 | Kawana et al. | H04N 1/02885 |
| 10,025,221 | B2 | 7/2018 | Iida et al. | G03G 15/043 |
| 2016/0246210 | A1* | 8/2016 | Fujii | G03G 15/043 |
| 2018/0329335 | A1* | 11/2018 | Iida | G03G 15/043 |

FOREIGN PATENT DOCUMENTS

| | | |
|---|---|---|
| JP | S61-025164 | 2/1986 |
| JP | 2000-351234 | 12/2000 |
| JP | 2016-000511 | 1/2016 |
| JP | 2017-094637 | 6/2017 |

* cited by examiner

*Primary Examiner* — Sophia S Chen
(74) *Attorney, Agent, or Firm* — Venable LLP

(57) ABSTRACT

An image forming apparatus includes: a photosensitive member; a charger unit configured to charge the photosensitive member; an exposing unit configured to form a latent image by scanning the photosensitive member by laser light which has a different spot diameter in accordance with a scanning position of the photosensitive member in a main scanning direction; a developing unit configured to develop an image by adhering a toner to the photosensitive member on which the latent image is formed; and a control unit configured to control a luminance of the laser light and a resolution of the photosensitive member in a sub-scanning direction in accordance with the scanning position of the photosensitive member in the main scanning direction.

17 Claims, 16 Drawing Sheets

IMAGE FORMING APPARATUS AND CONTROL METHOD THEREOF

BACKGROUND OF THE INVENTION

Field of the Invention

The present invention relates to an electrophotographic image forming apparatus and a control method thereof.

Description of the Related Art

As an exposure method adopted by an exposing unit of an electrophotographic image forming apparatus, there is a laser exposure method. In a laser exposure method, there is used a lens for guiding a beam of laser light from a light source unit to a scanning unit and for causing the beam of the laser light, which is deflected and scanned by the scanning unit, to form an image on a photosensitive member. It is desirable for the scanning speed of the laser light that scans the surface of the photosensitive member to be constant regardless of the position of the laser light on the surface of the photosensitive member. It is also desirable for the size (to be referred to as a spot diameter hereinafter) of a spot shape which is formed on the surface of the photosensitive member to be uniform regardless of the position of the spot shape on the surface of the photosensitive member. Hence, a lens that has an fθ characteristic is generally used as the image forming lens. By using a lens that has an fθ characteristic as the image forming lens, the scanning speed of the laser light that scans the surface of the photosensitive member will be constant regardless of the position of the laser light on the surface of the photosensitive member, and the size (to be referred to as the spot diameter hereinafter) of each spot shape formed on the surface of the photosensitive member will be uniform regardless of the position of the spot on the surface of the photosensitive member.

On the other hand, there is an example of a design in which an image forming lens that does not have an fθ characteristic is used for the purposes of downsizing and cost reduction. The scanning speed will not be constant and the spot diameter will not be uniform when an image forming lens that does not have the fθ characteristic is used. In Japanese Patent Laid-Open No. 2016-000511, there is disclosed a method of correcting the emission luminance of laser light so that the exposure amount per unit area on the surface of a drum will be constant without using an fθ-characteristic lens.

However, even in a case in which the emission luminance of the laser light is adjusted so that the exposure amount per unit area on the surface of the drum will be constant, the line widths will not be uniform since each spot diameter will differ depending on its position in the main scanning direction.

SUMMARY OF THE INVENTION

The present invention suppresses/prevents, in an image forming apparatus that uses an optical scanning device which has a different spot diameter depending on the position of the spot in the main scanning direction, line widths from becoming non-uniform in their respective positions in the main scanning direction.

According to one aspect of the present invention, there is provided an image forming apparatus comprising: a photosensitive member; a charger unit configured to charge the photosensitive member; an exposing unit configured to form a latent image by scanning the photosensitive member by laser light which has a different spot diameter in accordance with a scanning position of the photosensitive member in a main scanning direction; a developing unit configured to develop an image by adhering a toner to the photosensitive member on which the latent image is formed; and a control unit configured to control a luminance of the laser light and a resolution of the photosensitive member in a sub-scanning direction in accordance with the scanning position of the photosensitive member in the main scanning direction.

According to another aspect of the present invention, there is provided an image forming apparatus comprising: a photosensitive member; a charger unit configured to charge the photosensitive member; an exposing unit configured to form a latent image by scanning the photosensitive member by laser light which has a different spot diameter in accordance with a scanning position of the photosensitive member in a main scanning direction; a developing unit configured to develop an image by adhering a toner to the photosensitive member on which the latent image is formed; and a control unit configured to control a luminance of the laser light and an emission time of the laser light for each pixel position of the photosensitive member in the main scanning direction.

According to another aspect of the present invention, there is provided a control method of an image forming apparatus that includes a photosensitive member, a charger unit configured to charge the photosensitive member, an exposing unit configured to form a latent image by scanning the photosensitive member by laser light which has a different spot diameter in accordance with a scanning position of the photosensitive member in a main scanning direction, and a developing unit configured to develop an image by adhering a toner to the photosensitive member on which the latent image is formed, the method comprising: controlling a luminance of the laser light and a resolution of the photosensitive member in a sub-scanning direction in accordance with the scanning position of the photosensitive member in the main scanning direction.

According to another aspect of the present invention, there is provided a control method of an image forming apparatus that includes a photosensitive member, a charger unit configured to charge the photosensitive member, an exposing unit configured to form a latent image by scanning the photosensitive member by laser light which has a different spot diameter in accordance with a scanning position of the photosensitive member in a main scanning direction, and a developing unit configured to develop an image by adhering a toner to the photosensitive member on which the latent image is formed, the method comprising: controlling a luminance of the laser light and an emission time of the laser light for each pixel position of the photosensitive member in the main scanning direction.

The present invention can suppress/prevent, in an image forming apparatus that uses an optical scanning device which has a different spot diameter depending on the position of the spot in the main scanning direction, line widths from becoming non-uniform in their respective positions in the main scanning direction.

Further features of the present invention will become apparent from the following description of exemplary embodiments (with reference to the attached drawings).

DESCRIPTION OF THE EMBODIMENTS

Exemplary embodiments of the present invention will be described hereinafter with reference to the accompanying drawings. Note that the following embodiments are exemplary, and the present invention is not limited to the contents of the embodiments. Also, in each of the following drawings, components not necessary for the description of the embodiments will be omitted from the drawings.

<First Embodiment>

Figure 1:
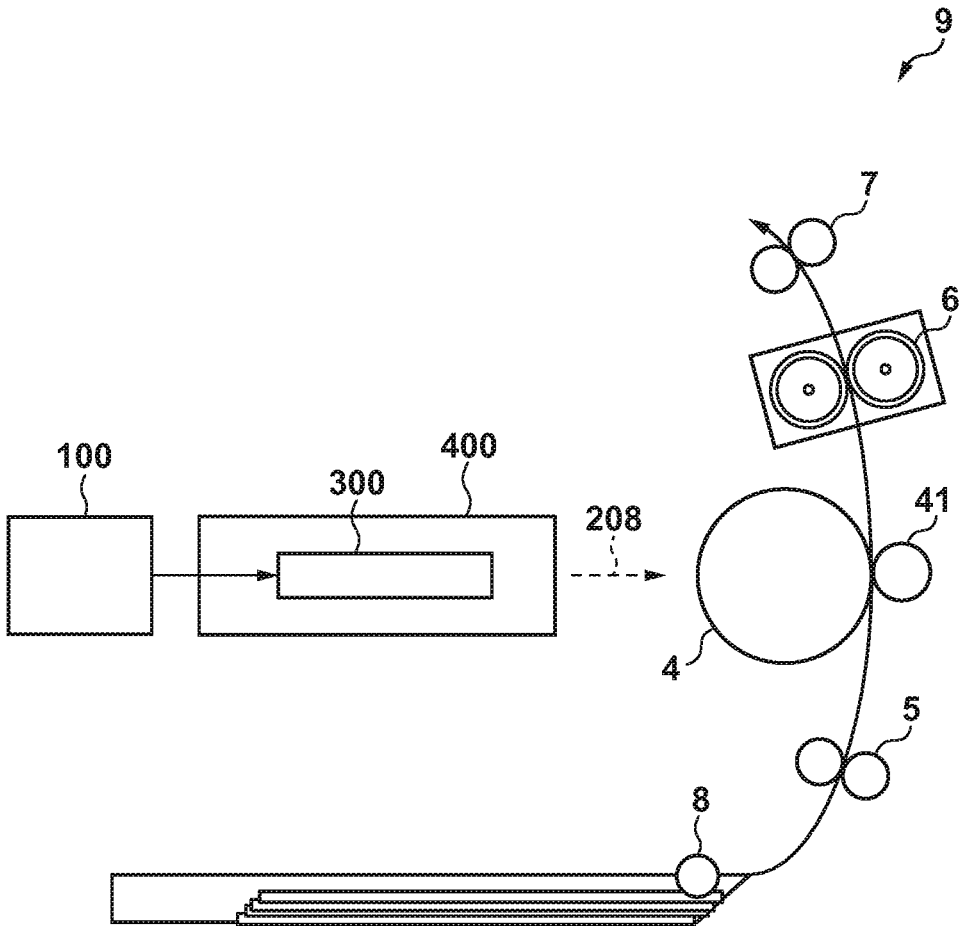
FIG. 1 is a view showing a schematic arrangement of an image forming apparatus.

FIG. 1 is a schematic view of the arrangement of an image forming apparatus 9 according to this embodiment. A laser driving unit 300 of an optical scanning device (scanning unit) 400 emits laser light 208 based on image data output from an image signal generation unit 100. The laser light 208 scans/exposes a photosensitive member 4, which is charged by a charger unit (not shown), and forms a latent image on the surface of the photosensitive member 4. A developing unit (not shown) forms a toner image by developing the image by causing a toner (developing agent) to adhere to this latent image. A recording medium (for example, a paper sheet) fed from a sheet feeding unit 8 is conveyed by rollers 5 to a nip region between the photosensitive member 4 and a transfer roller 41. The transfer roller 41 transfers the toner image formed on the photosensitive member 4 onto the conveyed recording medium. The recording medium is subsequently conveyed to a fixing unit 6. The fixing unit 6 fixes the toner image to the recording medium by heating and applying a pressure to the recording medium. The recording medium on which the toner image has been fixed is discharged outside the image forming apparatus 9 by sheet discharge rollers 7.

Figure 2A:
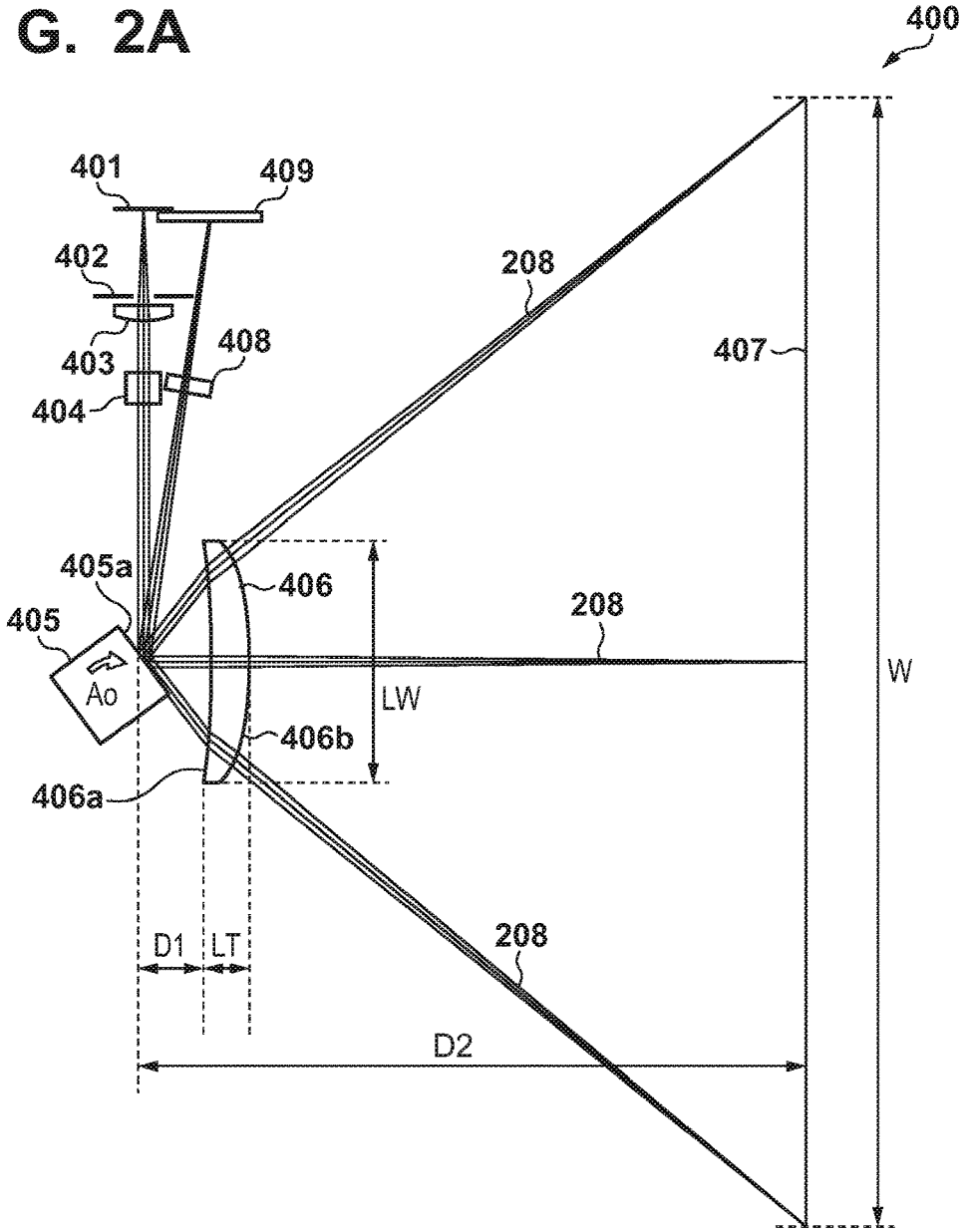
FIGS. 2A and 2B are views showing examples of the arrangement of a light scanning device.
Figure 2B:
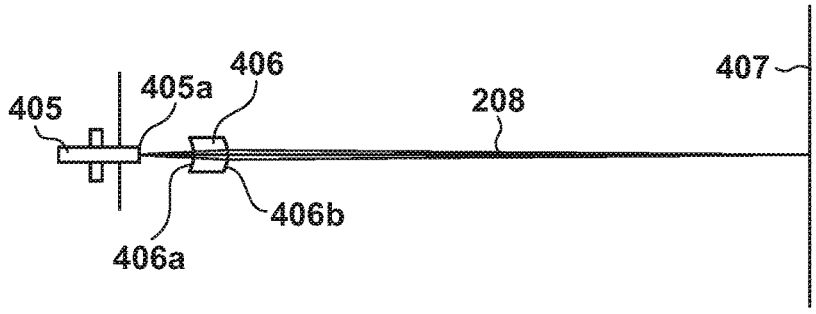

FIGS. 2A and 2B are views showing examples of the arrangement of an optical scanning device 400 according to this embodiment, FIG. 2A shows a section in a main scanning direction, and FIG. 2B shows a section in a sub-scanning direction. The laser light 208 emitted from a light source 401 is formed into an elliptical shape by an aperture stop 402 and enters a coupling lens 403. The laser light 208 that passed through the coupling lens 403 is converted into almost parallel light and enters an anamorphic lens 404. Note that almost parallel light includes weak converging light and weak diverging light. The anamorphic lens 404 has a positive refractive power in a main scanning section, and converts the light beams, which have entered, into converging light in the main scanning section. Also, in the sub-scanning section, the anamorphic lens 404 condenses light beams near a reflection surface 405*a* of a deflector 405 and forms a long line image in the main scanning direction.

The light beams that passed through the anamorphic lens 404 are reflected by the reflection surface 405*a* of the deflector (polygon mirror) 405. Although the deflector 405 is exemplified here by a deflector formed from four reflection surfaces, the number of reflection surfaces is not limited to this. The laser light 208 reflected by the reflection surface 405*a* is transmitted through an image forming lens 406, is formed into an image on the surface of the photosensitive member 4, and forms a predetermined spot-shape image (to be written as a "spot" hereinafter). The deflector 405 is rotated by a driving unit (not shown) in the direction of an arrow AO (clockwise direction in FIG. 2A) at a constant angular velocity to move the spot in the main scanning direction on a scanning target surface 407 of the photosensitive member 4, and an electrostatic latent image is formed on the scanning target surface 407. Note that the main scanning direction is a direction parallel to the surface of a photosensitive member 4 and is perpendicular to the movement direction of the surface of the photosensitive member 4. In the case of the example shown in FIG. 2A, the main scanning direction corresponds to a width direction W of the photosensitive member 4. The sub-scanning direction is the movement direction of the surface of the photosensitive member 4.

A beam detect (to be written as "BD" hereinafter) sensor 409 and a BD lens 408 form a synchronization optical system that determines the timing to write the electrostatic latent image on the scanning target surface 407. The laser light 208 that passed through the BD lens 408 enters and is detected by the BD sensor 409 which includes a photo diode. A BD signal will be output each time the reflection surface of the deflector 405 is switched. The write timing is controlled based on the timing at which the laser light 208 is detected by the BD sensor 409. Although the light source 401 according to this embodiment includes only one emission unit, a light source that includes a plurality of emission units whose emission can be independently controlled may be used as the light source 401.

As shown in FIGS. 2A and 2B, the image forming lens 406 includes two optical surfaces (lens surfaces), an incident surface 406*a* and exit surface 406*b*. The image forming lens 406 is arranged so that the light beams deflected by the reflection surface 405*a* will scan the scanning target surface 407 in a desired scanning characteristic in the main scanning section. The image forming lens 406 is arranged to form the spot of the laser light 208 into a desired shape on the scanning target surface 407.

The image forming lens 406 according to this embodiment does not have a so-called fθ characteristic. The optical scanning device 400 can be downsized by using the image forming lens 406 without the fθ characteristic. That is, it becomes possible to arrange the image forming lens 406 near (a position where a distance D1 is small) the deflector 405. The image forming lens 406 without the fθ characteristic can reduce a length (width LW) in the main scanning direction and a length (thickness LT) in an optical axis direction more than an image forming lens with the fθ characteristic.

Since the image forming lens 406 according to this embodiment does not have the fθ characteristic, the spot will not move on the scanning target surface 407 at a constant velocity when the deflector 405 is being rotated at a constant angular velocity. Also, the spot diameter will not be uniform on the scanning target surface 407. In particular, since the angle of field increases as an optical path length D2 from the deflector 405 to the photosensitive member 4 becomes shorter, it increases the scanning speed difference and the spot diameter difference between the above-described on-axis image height and a most off-axis image height. An object of this embodiment is to maintain image quality in such an optical arrangement.

[Partial Magnification Correction]

Figure 3:
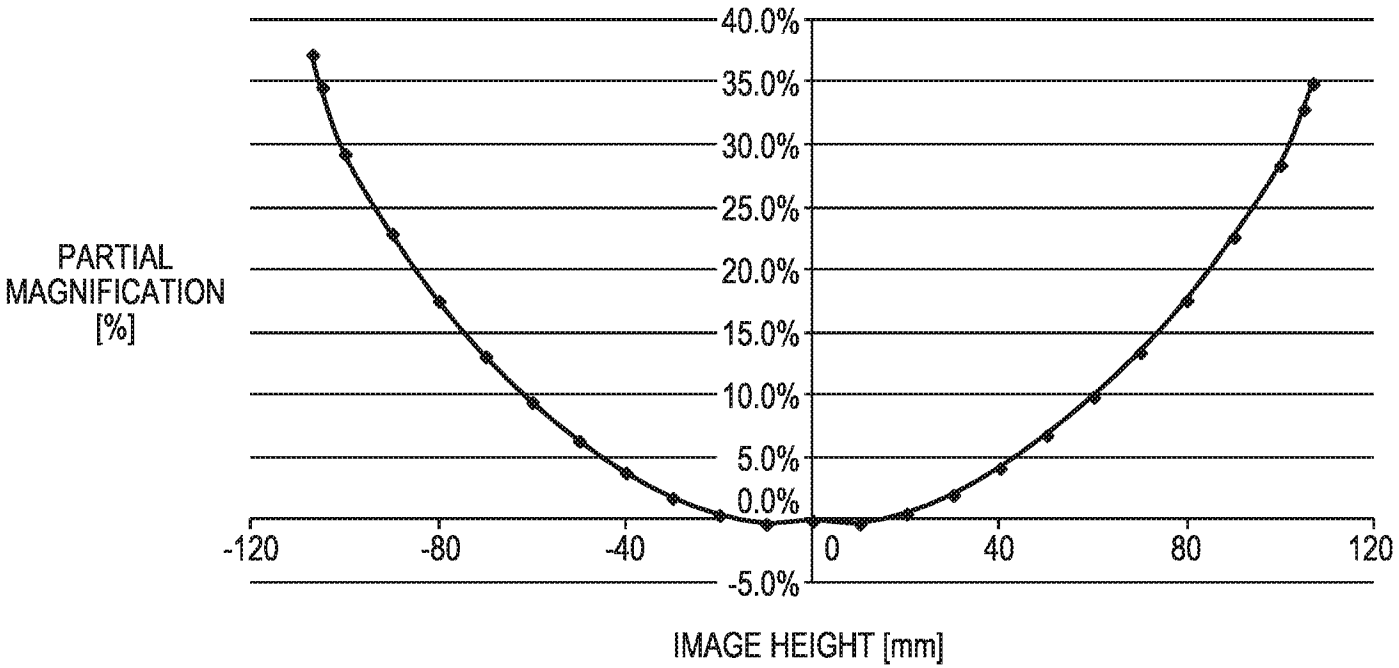
FIG. 3 is a graph showing the relationship between an image height and a partial magnification.

FIG. 3 shows the relationship between an image height and a partial magnification. In FIG. 3, the abscissa indicates an image height [mm] and the ordinate indicates a partial magnification [%]. Note that an image height of 0 is obtained when the spot is on the optical axis of the image forming lens 406, and this will be referred to as an "on-axis image height" hereinafter. Also, an image height other than the on-axis image height will be referred to as an "off-axis image height" hereinafter. Furthermore, the maximum absolute value of the image height will be referred to as the "most off-axis image height". As shown in FIG. 2A, the position of the most off-axis image height on the scanning target surface 407 is W/2 from the center. In FIG. 3, for example, a partial magnification of 30% of an image height represents that the scanning speed at the image height is 1.3 times the scanning speed at the image height with a partial magnification of 0%. In the example of FIG. 3, the scanning speed is lowest at the on-axis image height, and the scanning speed increases in accordance with the increase in the absolute value of the image height. Hence, if pixel widths in the main scanning direction are determined based on a constant time interval which is determined by a clock cycle, the pixel density will differ between the on-axis image height and an off-axis image height. Therefore, partial magnification correction is performed in this embodiment. More specifically, the clock frequency will be adjusted in accordance with the image height so that the pixel widths will become uniform regardless of the image height. Note that a method of partial magnification correction is not limited to a method targeting the clock frequency. For example, it may be a method in which the pixel width is adjusted by inserting/removing a pixel fragment formed of a pixel whose size is less than one pixel at any of the positions on the main scanning direction.

Figure 4:
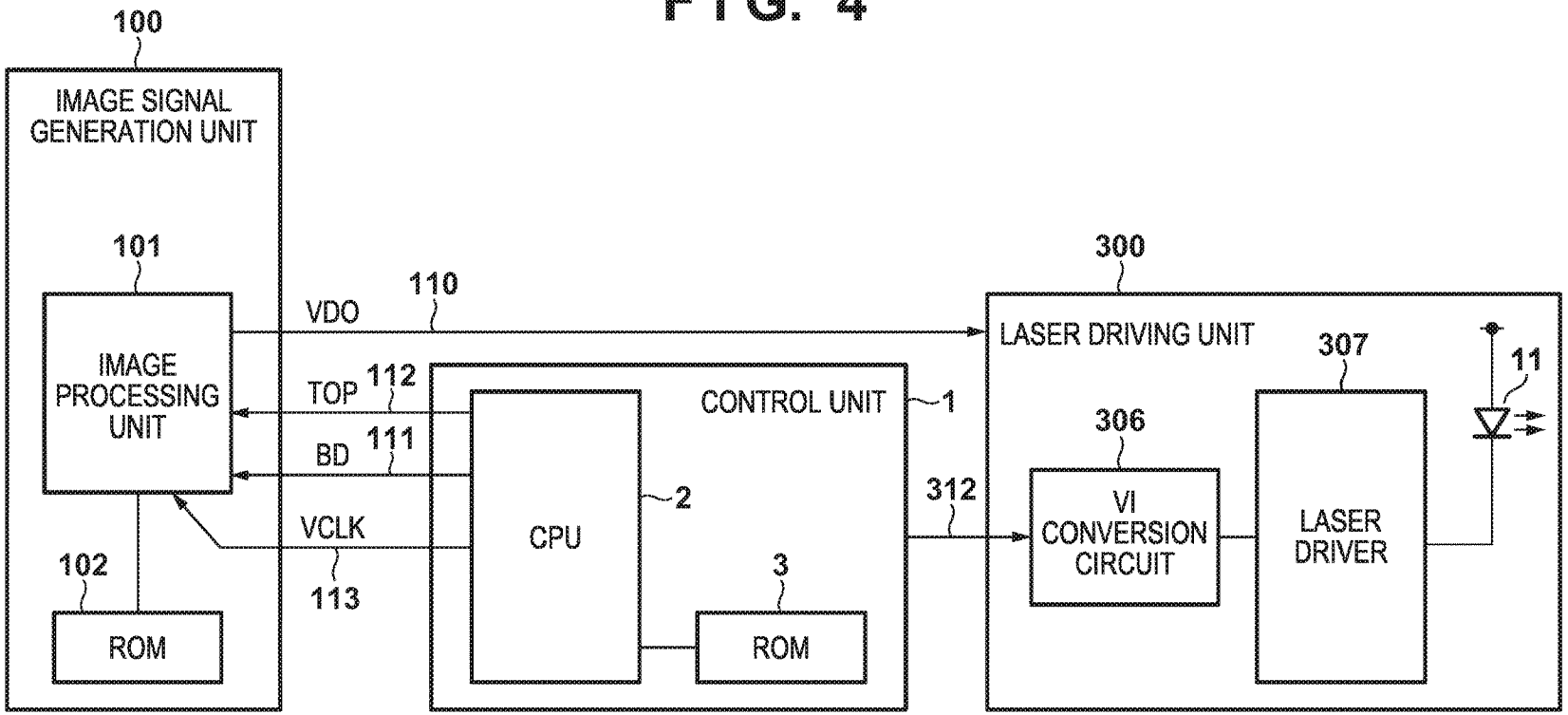
FIG. 4 is an electrical block diagram of an exposure control arrangement.
Figure 5:
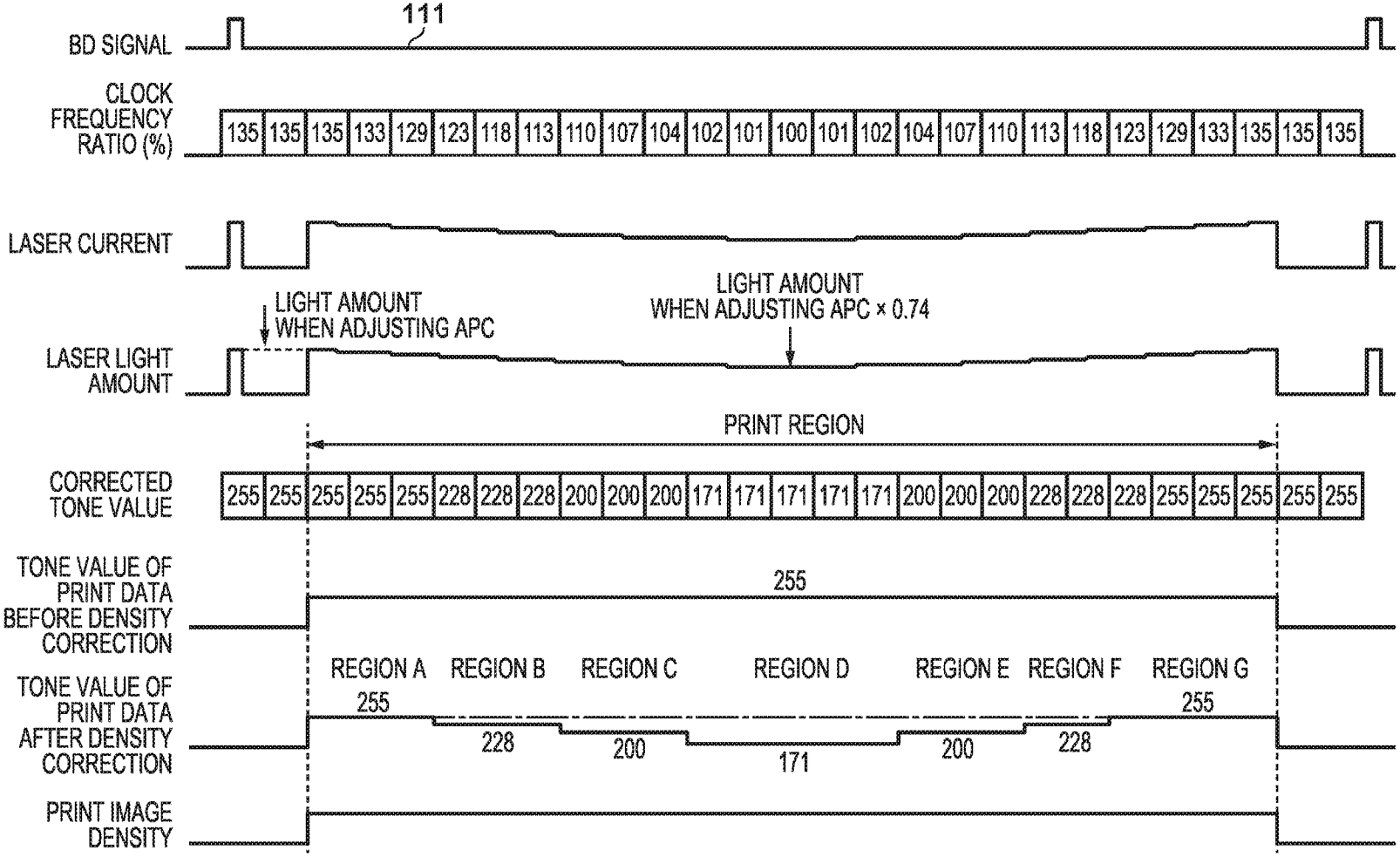
FIG. 5 is a timing chart showing the timing relationship between various kinds of synchronization signals and an image signal.

FIG. 5 is a timing chart showing an example of the partial magnification correction described above. In FIG. 5, as an example, a case in which a partial magnification correction of 135% is to be performed at the most off-axis image height when the change in the scanning speed is 35% and the on-axis image height is set as 100% is described. A ROM 3 of FIG. 4 stores a clock frequency ratio related to the optical scanning device 400, and a CPU 2 controls the clock frequency by transmitting a video clock signal VCLK113 to an image processing unit 101 based on this information. That is, assume that the clock frequency ratio of a VDO signal 110 transmitted from the image processing unit 101 will be 135% at the most off-axis image height when the on-axis image height is set as 100%. In this case, assume that a period in which the spot of the laser light 208 will move by only the width (for example 42.3 μm) of one pixel on the scanning target surface 407 will be 0.74 times the on-axis image height at the most off-axis image height. In this manner, each pixel width is corrected by controlling the exposure time of the laser light 208 at the pixel position corresponding to one pixel, and thus it becomes possible to form a latent image corresponding to each pixel at substantially equal intervals with respect to the main scanning direction and of equal sizes. Note that, even in a case in which partial magnification correction is performed by adopting a method of inserting/removing a pixel fragment as described above, the size of the pixel fragment to be inserted/removed is switched based on the ratio shown in FIG. 3.

However, in a case in which the luminance of the light source 401 is constant, the total exposure amount per unit length near the most off-axis image height will become less than the total exposure amount per unit length near the on-axis image height. Therefore, in this embodiment, in order to achieve good image quality, luminance correction is performed to correct the total exposure amount per unit length together with the above-described partial magnification correction.

[Luminance Correction]

Luminance correction will be described next with reference to FIGS. 4 and 5.

FIG. 4 is a block diagram showing a schematic arrangement of each part used for image formation. Here, a control unit 1, the image signal generation unit 100, and the laser driving unit 300 are shown. The control unit 1 includes the CPU 2, and transmits, upon preparation for printing being complete, a TOP signal 112, which is a sub-scanning synchronization signal, and a BD signal 111, which is a main-scanning synchronization signal, to the image signal generation unit 100. The control unit 1 further includes the ROM 3, a DA converter (not shown), and a regulator (not shown), and forms a luminance correction unit in combination with the laser driving unit 300. The laser driving unit 300 includes a VI conversion circuit 306 that converts a voltage into a current and a laser driver IC 307, and supplies a drive current to an emission unit 11 which is the laser diode of the light source 401. The ROM 3 stores partial magnification characteristic information and information of correction current which is to be supplied to the emission unit 11.

The operation of the laser driving unit 300 will be described next. Based on the information of the correction current for the emission unit 11 stored in the ROM 3, the control unit 1 outputs, in synchronization with a BD signal 111, a luminance correction analog voltage 312 that is increased and decreased in the main scanning direction with respect to the photosensitive member 4. The luminance correction analog voltage 312 is converted into a current value in the VI conversion circuit 306 of the succeeding stage, and is output to the laser driver IC 307.

The laser driver IC 307 automatically makes adjustments by performing feedback control by a circuit inside the laser driver IC 307 so that the luminance detected by a photodetector (not shown) arranged in the light source 401 as a light amount monitor of the emission unit 11 will be a desired luminance. A so-called APC (Auto Power Control) will be performed. The automatic adjustment of the luminance of the emission unit 11 is performed, as shown in FIG. 5, while the emission unit 11 is emitting light to detect the BD signal outside the print region for each main scanning line.

As the luminance correction method of the emission unit 11, a current necessary for acquiring the luminance at the most off-axis image height is automatically adjusted by APC, and the luminance correction analog voltage 312 is controlled based on the information of the correction current for the emission unit 11 stored in the ROM 3. In addition, correction is performed so that the luminance will increase in accordance with the increase in the absolute value of the image height by subtracting a predetermined amount of current from the drive current of the emission unit 11. That is, control is performed so that the luminance of the laser light 208 will become lower as the scanning position becomes closer to the center (on-axis image height) in the main scanning direction of the photosensitive member 4. As a result, the on-axis image height becomes 74% (≈100%/135%) when the luminance of the light source 401 is set to be 100% at the most off-axis image height, and correction is performed so that the total exposure amount (integral light amount) for one pixel will be constant at each image height.

Note that the luminance correction method is not limited to the method described above. For example, it may be arranged so that density correction may be performed in accordance with the drawing position (main scanning position) on the photosensitive member 4 with respect to the input image data which serves as the original data, and image formation may be performed based on the image data that have undergone this density correction. For example, as also shown in FIG. 5, as a result of density correction processing, the tone value of 255 is corrected to 255 in Region A, 228 in Region B, 200 in Region C, 171 in Region D, 200 in Region E, 228 in Region F, and 255 in Region G. Density correction values may be stored in ROM 102 (see FIG. 4).

[Image Processing]

Figure 6:
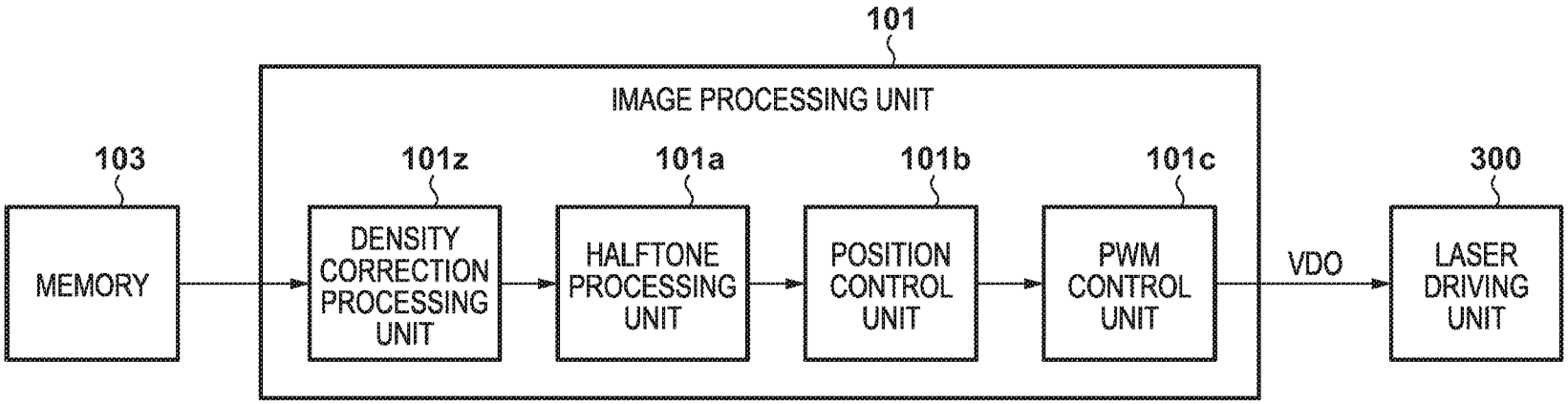
FIG. 6 is a functional block diagram showing the procedure of image processing.

The procedure of image processing of the image forming apparatus according to this embodiment will be described next. FIG. 6 is a functional block diagram for explaining the image processing performed at the time of printing. The image processing unit 101 includes, as shown in FIG. 6, a density correction processing unit 101*z*, a halftone processing unit 101*a*, a position control unit 101*b*, and a PWM control unit 101*c*, and executes the image processing to be described below.

The image forming apparatus according to this embodiment performs image processing to obtain a continuous halftone image by performing tone conversion based on a dither method. Print data input from a host computer (not shown) is temporarily accumulated in a memory 103. Subsequently, after the print data is read out from the memory 103 and is processed by the density correction processing unit 101*z* (to be described later), the print data is transmitted to the halftone processing unit 101*a*. The halftone processing unit 101*a* performs multi-value dither processing on the print data of an 8-bit depth (256 tones), and converts the print data into image data of a 5-bit depth (32 tones). The position control unit 101*b* uses a position control matrix corresponding to the dither matrix used by the halftone processing unit 101*a* for the multi-value dither processing to add 2-bit position control data representing the dot growth direction to the image data output by the halftone processing unit 101*a*. The PWM control unit 101*c* performs PWM control to convert the 7-bit image data obtained from the addition of the position control data into the VDO signal 110 which serves as a pulse signal, and outputs the converted signal to the laser driving unit 300.

By performing image processing by using such a dither method, the print data is converted into the VDO signal 110 for exposure which has undergone halftone processing to appropriately express the tones in the image forming apparatus 9.

[PWM Processing]

Figure 7:
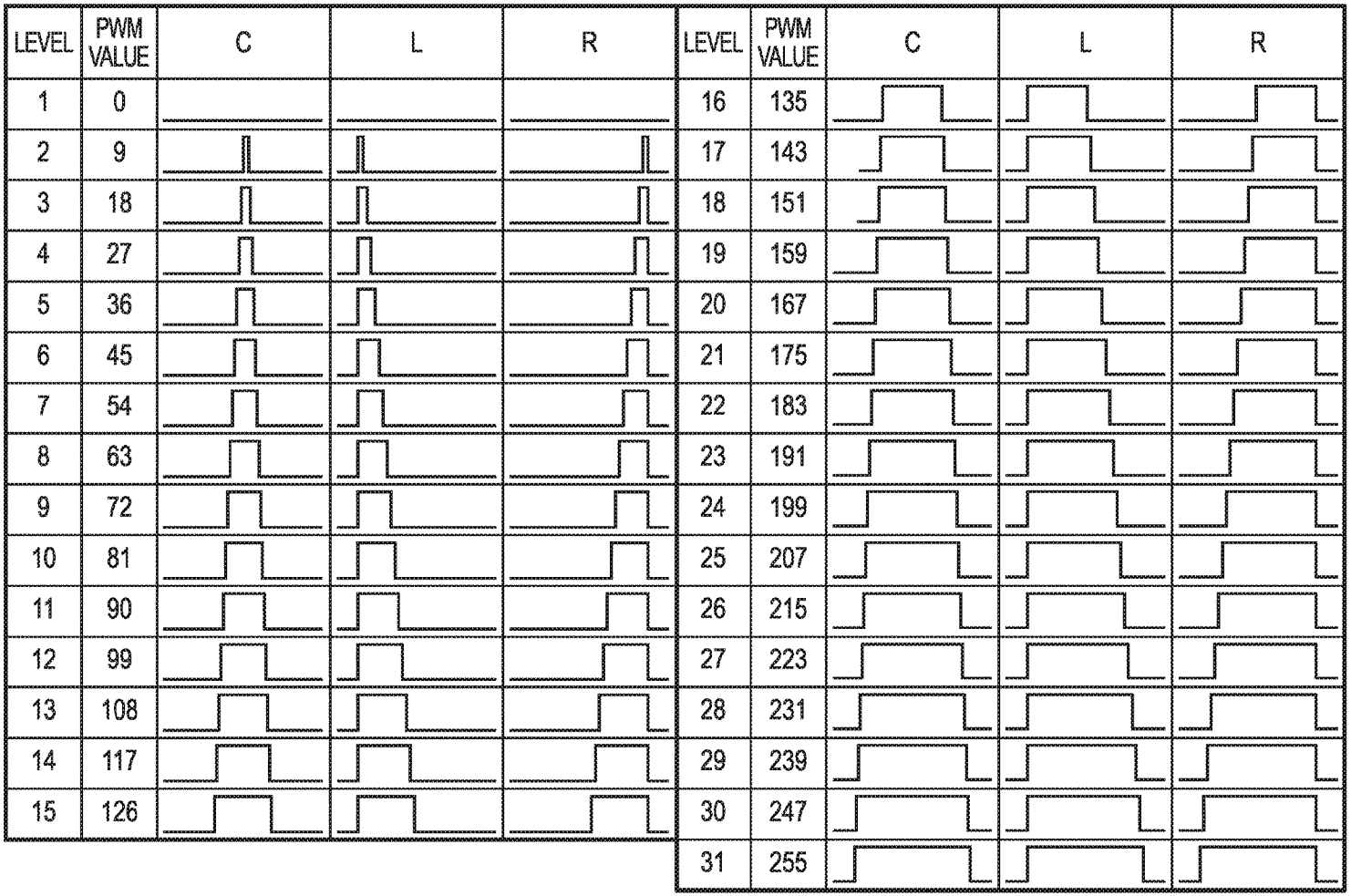
FIG. 7 is a view showing an example of a pulse signal table according to the first embodiment.

PWM (Pulse Width Modulation) processing performed by the PWM control unit 101*c* will be described. FIG. 7 shows an example of a table showing the relationship between the data (7 bits) assigned to each pixel by the position control unit 101*b* and the pulse signal generated by the PWM processing. This table includes information related to the width (PWM value) of the pulse signal and the position of the pulse. The PWM control unit 101*c* generates a pulse signal by performing PWM processing by dividing the 7-bit data assigned to each pixel of the input image data into lower 5-bit data (level value: 0 to 31) and upper 2-bit data (position control data: C, L, R).

As the PWM value, an integer value selected from a range of 0 to 255 is assigned to each of the levels 0 to 31. A pulse position is information corresponding to a delay amount of a leading edge position of the pulse from a reference position (for example, the starting point of one pixel) of an image clock defining the pixel interval to which the pulse signal is to be synchronized. In the table shown in FIG. 7, it is set so that the pulse width will increase, together with the increase in the level from level 0 (no emission), in the pulse position and the growth direction corresponding to the position control data. When the position control data is at C, the pulse width grows almost in the same manner in a left-and-right direction from a reference position at the center of one pixel. When the position control data is at L, the pulse width grows in the right direction from a reference position at the left end of one pixel. When the position control data is at R, the pulse width grows in the right direction from the reference position on at the right end of one pixel. When it reaches level 31, the PWM value is set to 255, and emission occurs with respect to the full pixel width of one pixel. By performing processing in this manner, the 7-bit image data is converted into the video signal (VDO signal 110) which is to serve as the pulse signal. Note that the degree of pulse width growth corresponding to the level is not limited to those shown in FIG. 7, and an arbitrary degree of growth may be set.

[Light Amount Profile]

Figure 8:
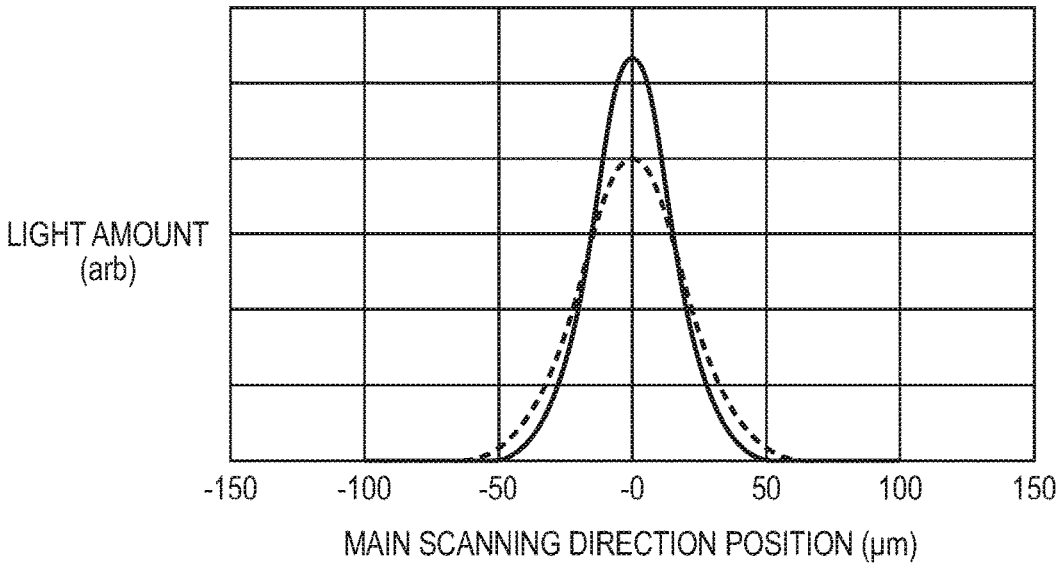
FIG. 8 is a graph showing an example of an amount-of-light profile according to the first embodiment.

Assume that a laser spot diameter on the scanning target surface 407 of the optical scanning device 400 according to this embodiment is 60 μm at the on-axis image height and is 80 μm at the most off-axis image height. As described above, since the distance between the deflector 405 and the scanning target surface 407 of the photosensitive member 4 is larger on the side of an end (most off-axis image height) in the main scanning direction of the deflector 405, the spot diameter increases as closer the position gets to the side of the end. FIG. 8 shows an example of a still spot light amount profile. The ordinate indicates an amount [arb] of light and the abscissa indicates a main scanning direction position [μm]. In addition, the solid line in FIG. 8 indicates the still spot light amount profile at the on-axis image height and the dotted line indicates a still spot light amount profile at the most off-axis image height.

Figure 13:
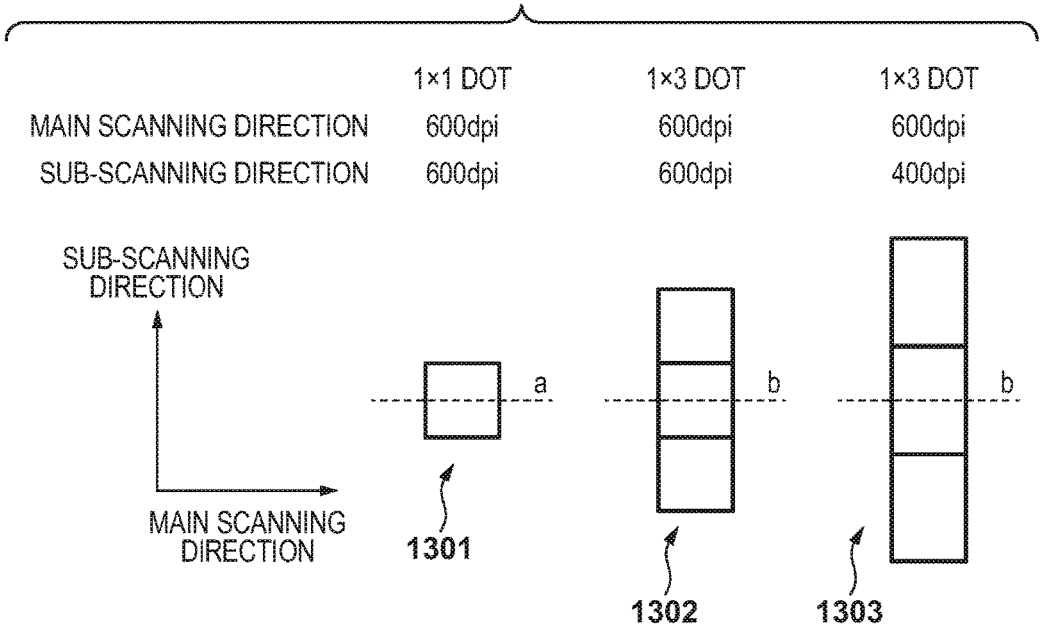
FIG. 13 is a view showing a 1×1 dot image and 1×3 dot images.

An accumulated light amount profile in the main scanning direction corresponding to a 1×1 dot image shown as a dot image 1301 in FIG. 13 will be described next. In FIG. 13, the axis a corresponds to the main scanning direction, and a direction perpendicular to this axis will be described as the sub-scanning direction. The accumulated light amount profile of 1×1 dot in the main scanning direction is calculated by adding the still spot light amount profile shown in FIG. 8 to the amount of one dot (width of one pixel: 42.3 μm) in the main scanning direction. That is, in the case of 1×1 dot, there is no influence from the accumulated light amount profiles of other dots since there are no other adjacent dots.

A dot image 1302 of FIG. 13 shows a vertical line image of 1×3 dots in which each of the resolution in the main scanning direction and that in the sub-scanning direction is 600 dpi. A dot image 1303 of FIG. 13 shows a vertical line image of 1×3 dots in which the resolution in the main scanning direction is 600 dpi and the resolution in the sub-scanning direction in the sub-scanning direction is 400 dpi.

The accumulated light amount profile of the vertical line image of 1×3 dots is calculated by adding three accumulated light amount profiles of the 1×1 dot image in the sub-scanning direction. The accumulated light amount profile on an axis b is influenced by dots other than the center dot, that is, the accumulated light amount profiles of dots in the upper and lower positions, respectively. Here, in a case in which the resolution in the sub-scanning direction is 400 dpi, the amount of overlap between the accumulated light amount profiles of each 1×1 dot of the dots becomes smaller than that in a case in which the resolution is 600 dpi. Hence, the accumulated light amount profile in the main scanning direction on the axis b in a case in which the resolution in the sub-scanning direction is 400 dpi will have a lower peak value and tails having a smaller distance therebetween than the accumulated light amount profile in the main scanning direction on the axis b in a case in which the resolution in the sub-scanning direction is 600 dpi.

Figure 9A:
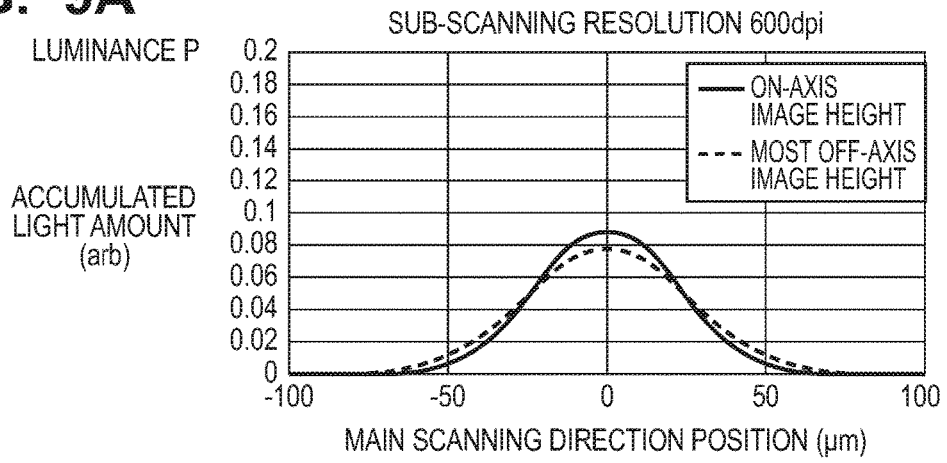
FIGS. 9A to 9F are graphs each showing an example of an accumulated light amount profile according to the first embodiment.
Figure 9B:
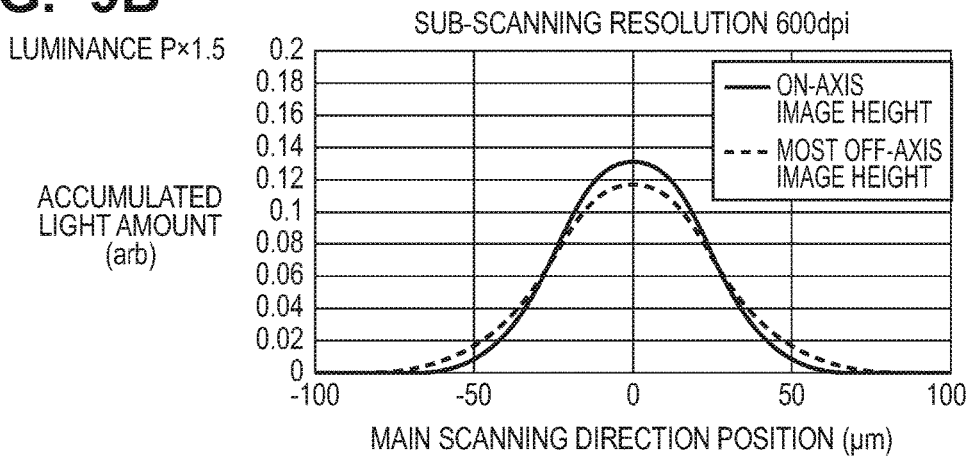
Figure 9C:
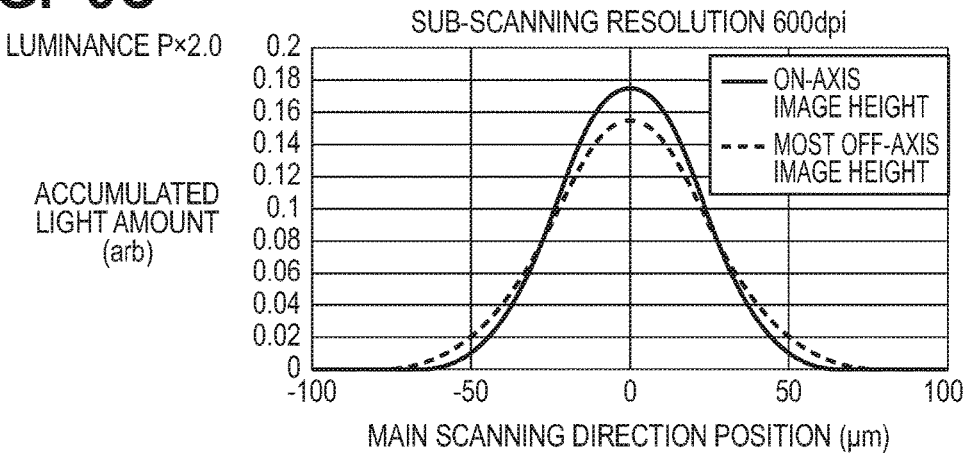
Figure 9D:
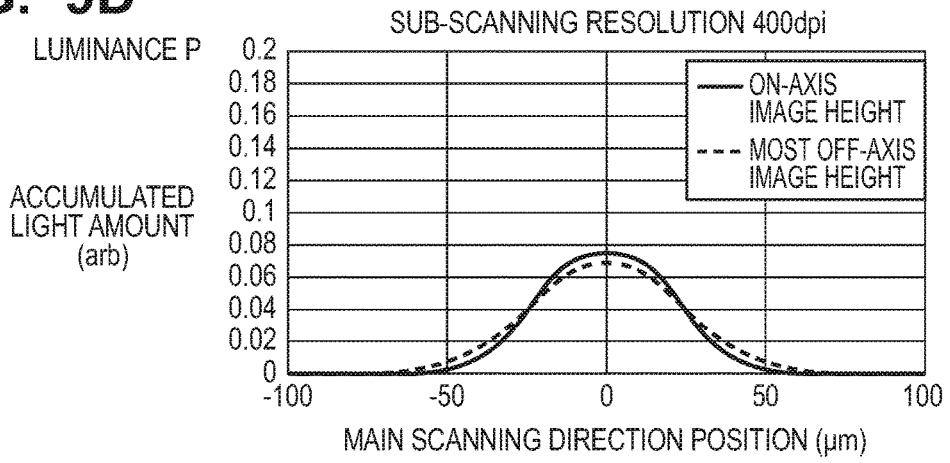
Figure 9E:
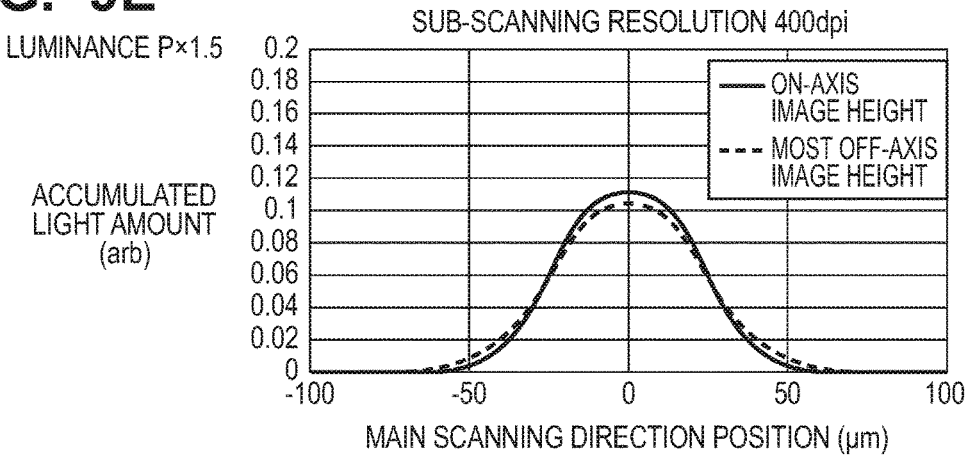
Figure 9F:
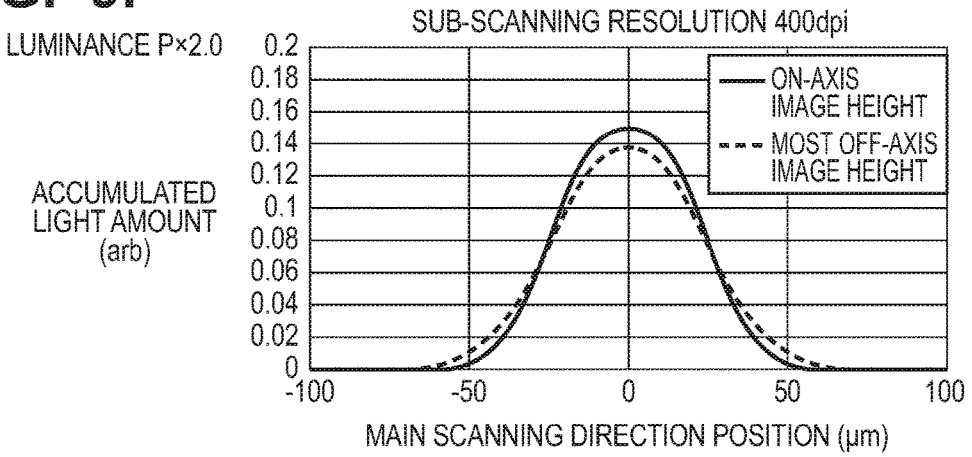

FIGS. 9A to 9F show the accumulated light amount profiles of a case in which the resolution in the sub-scanning direction is 600 dpi and that in a case in which the resolution in the sub-scanning direction is 400 dpi. In each of the accumulated light amount profiles show in FIGS. 9A to 9F, the ordinate indicates an amount [arb] of accumulated light and the abscissa indicates a main scanning direction position [μm]. FIGS. 9A and 9C each show the accumulated light amount profile of the 1×3 dot image in a case in which the resolution in the sub-scanning direction is 600 dpi. On the other hand, FIGS. 9D to 9F each show the accumulated light amount profile in a case in which the resolution in the sub-scanning direction is 400 dpi. Also, the accumulated light amount profiles in the main scanning direction on the axis b of a case in which the luminance is P are shown in FIGS. 9A and 9D, of a case in which the luminance is P×1.5 are shown in FIGS. 9B and 9E, and of a case in which the luminance is P×2.0 are shown in FIGS. 9C and 9F.

In FIGS. 9A to 9F, the solid line indicates the accumulated light amount profile at the on-axis image height, and the dotted line indicates the accumulated light amount profile at the most off-axis image height. As shown in FIGS. 9A to 9F, regardless of the luminance, the accumulated light amount profile at the most off-axis image height has a lower peak value of the accumulated light amount and has tails having a larger distance therebetween than the accumulated light amount profile at the on-axis image height. The accumulated light amount profile at the on-axis image height and that at the most off-axis image height differ in this manner because the still spot light amount profile has, as shown in FIG. 8, a lower peak value and tails having a larger distance therebetween at the most off-axis image height than at the on-axis image height. Also, when the profiles of cases which have the same luminance but have different resolutions in the sub-scanning direction, the peak value becomes lower and the tails have a smaller distance therebetween for the profile with the lower resolution in the sub-scanning direction.

[E-V Curve]

Figure 10:
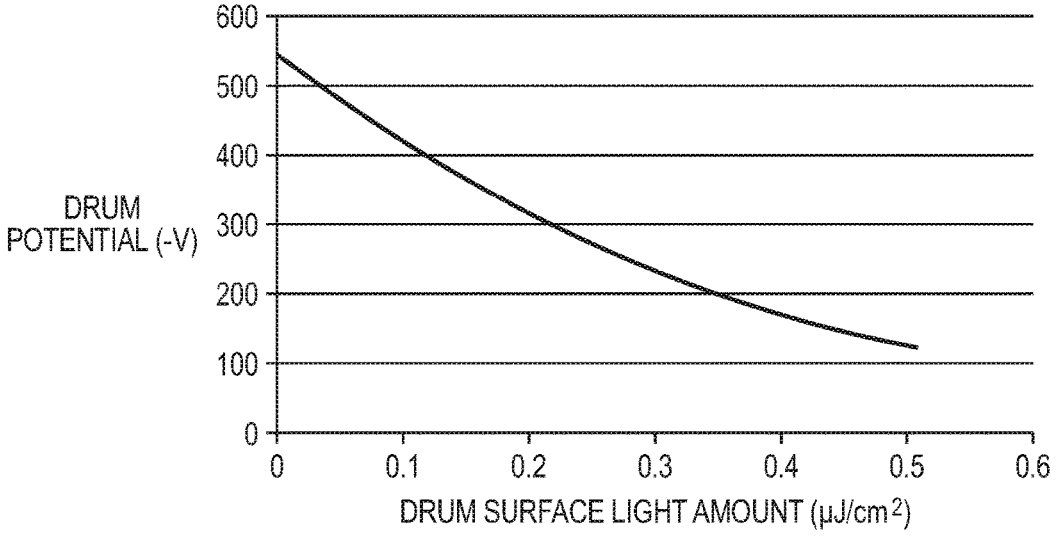
FIG. 10 is a graph for explaining an E-V curve.

FIG. 10 shows the relationship (E-V curve) between the drum surface exposure amount per unit area and a drum potential of the photosensitive member 4 (photosensitive drum) according to this embodiment. In FIG. 10, the ordinate indicates a drum potential [−V] and the abscissa indicates an amount of light on the drum surface [μJ/cm2]. As shown in FIG. 10, the surface potential of the photosensitive member 4 when the exposure amount is 0, that is, when the light source 401 is not emitting light is about −540 V, and there is a tendency for the potential of the photosensitive member 4 to decrease (the absolute value becomes smaller) as the exposure amount increases.

[Potential Profile]

Figure 11A:
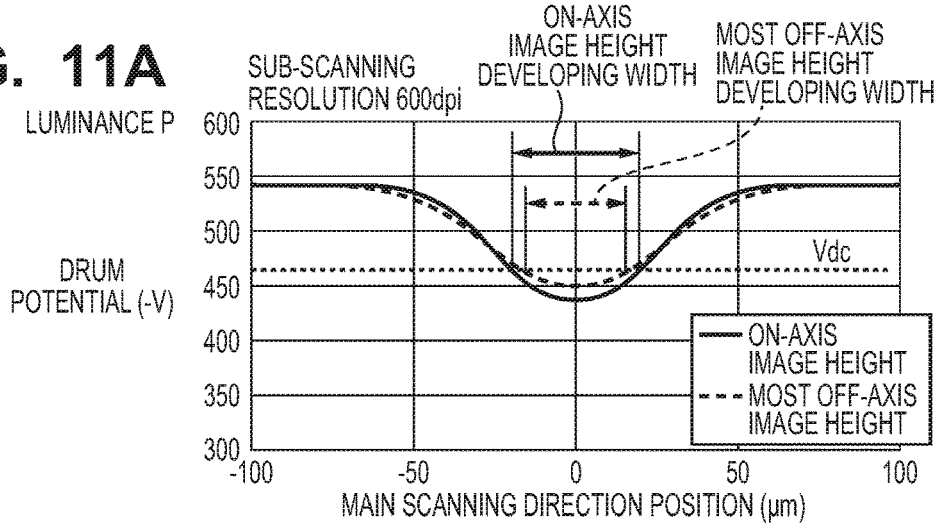
FIGS. 11A to 11F are graphs each showing an example of a potential profile according to the first embodiment.
Figure 11B:
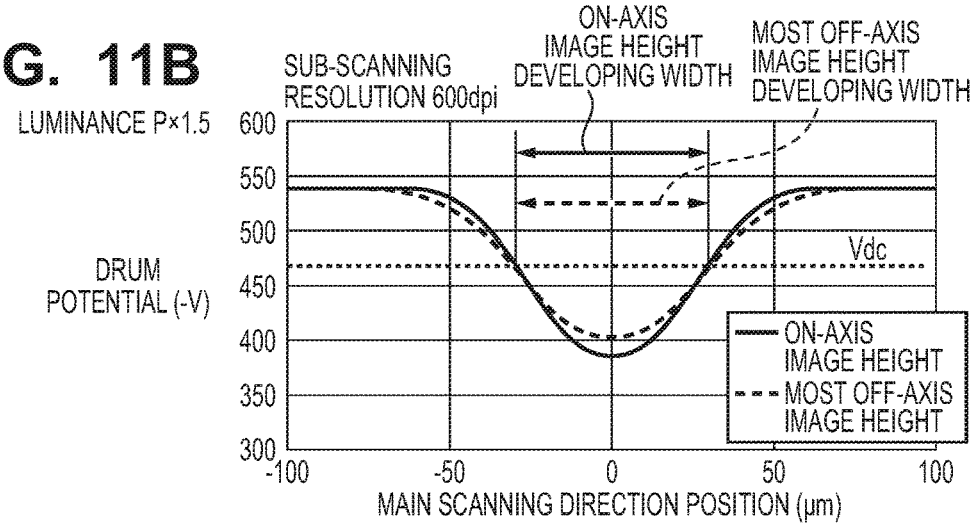
Figure 11C:
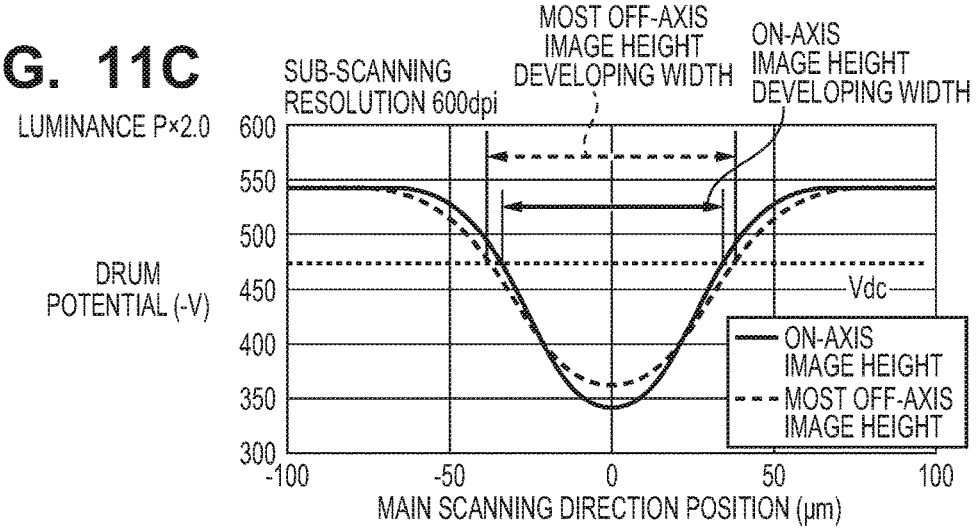
Figure 11D:
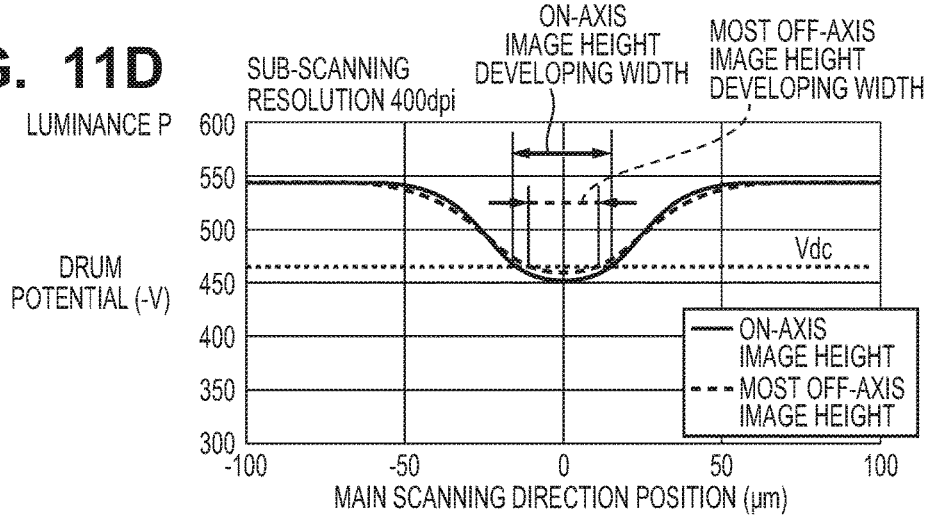
Figure 11E:
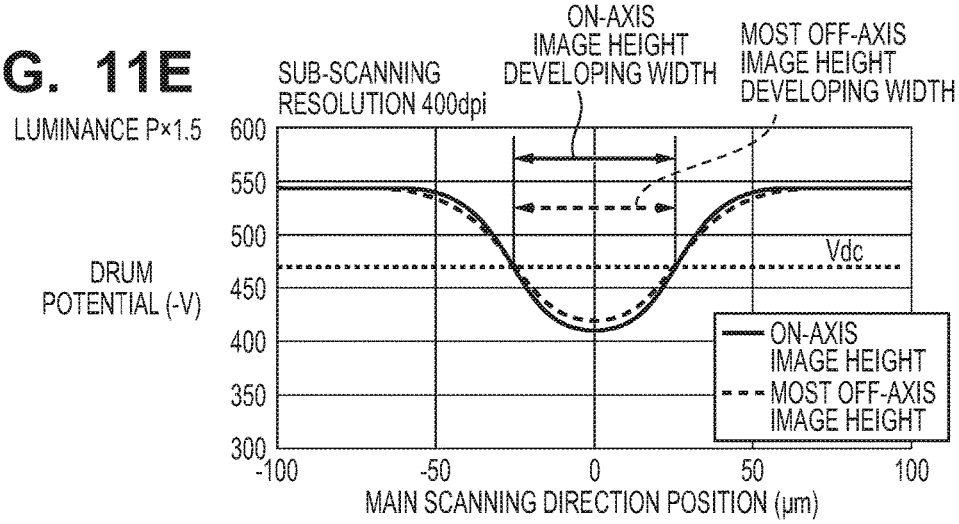
Figure 11F:
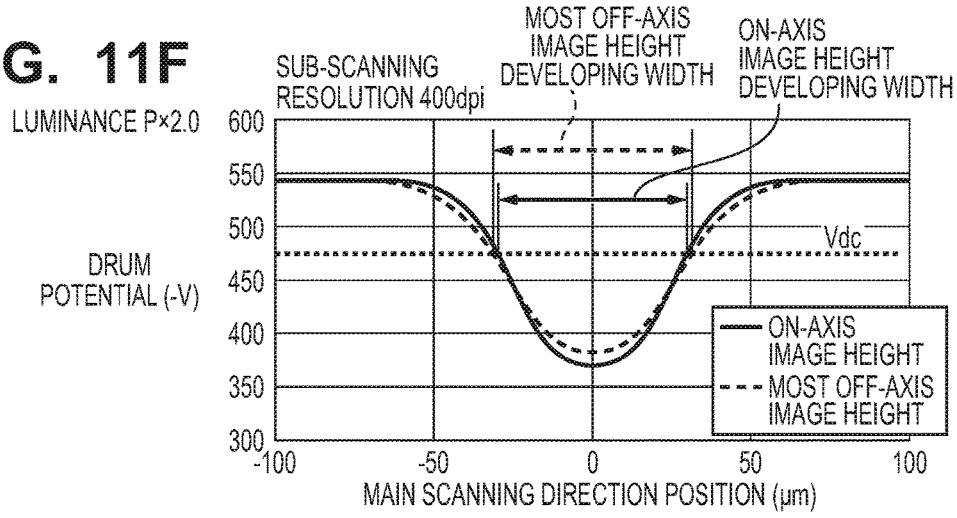

FIGS. 11A to 11F show potential profiles calculated based on accumulated light amount profiles shown in FIGS. 9A to 9F and the potential profiles calculated based on the E-V curve shown in FIG. 10. In each of the potential profiles shown in FIGS. 11A to 11F, the ordinate indicates a drum potential [−V], and the abscissa indicates a position [μm] in the main scanning direction. FIGS. 11A to 11C show profiles of the surface potential of the photosensitive member 4 on an axis b of a 1 ×3 dot image in a case in which the resolution in the sub-scanning direction is 600 dpi. On the other hand, FIGS. 11D to 11F show potential profiles of a case in which the resolution in the sub-scanning direction is 400 dpi. In addition, the potential profiles in the main scanning direction on each axis of a case in which the luminance is P are shown in FIGS. 11A and 11D, and of a case in which the luminance is P×1.5 are shown in FIGS. 11B and 11E, and of a case in which the luminance is P×2.0 are shown in FIGS. 11C and 11F.

In FIGS. 11A to 11F, the solid line indicates the potential profile at the on-axis image height, and the dotted line indicates the potential profile at the most off-axis image height. As shown in FIGS. 11A to 11F, regardless of the luminance, the potential profile at the most off-axis image height has a lower peak value and has tails having a larger distance therebetween than the potential profile at the on-axis image height. The potential profile at the on-axis image height and that at the most off-axis image height differ in this manner because, as shown in FIGS. 9A to 9F, the accumulated light amount profile has a lower peak value and tails having a larger distance therebetween at the most off-axis image height than at the on-axis image height.

A broken line Vdc shown in FIGS. 11A to 11F indicates a developing potential (−470 V in this case) according to this embodiment, and a width of an arrow shown in FIGS. 11A to 11F indicates the width (to be referred to as a "developing width" hereinafter) of a portion in which the drum potential will be equal to or less than the developing potential. Correlation between this developing width and the line widths (to be described later) has been proven by experiments.

As shown in FIGS. 11A and 11D, in a case in which the luminance is P, the potential profile at the most off-axis image height becomes shallower than the potential profile at the on-axis image height, and thus the aforementioned developing width becomes smaller. On the other hand, in a case in which the luminance is P×1.5 as shown in FIGS. 11B and 11E, the potential profile becomes deeper, and thus the aforementioned developing width becomes larger. In particular, the developing width becomes significantly larger for the most off-axis image height. This is because the most off-axis image height has more influence on the developing width when the luminance is increased since the potential profile of the most off-axis image height has a larger range.

In a case in which the luminance is further increased and set to P×2.0 as shown in FIGS. 11C and 11F, the magnitude relationship is reversed with that in the case in which the luminance is set to P, and the developing width of the most off-axis image height will be larger than that of the on-axis image height.

[Line Width Measurement Result]

Figure 12:
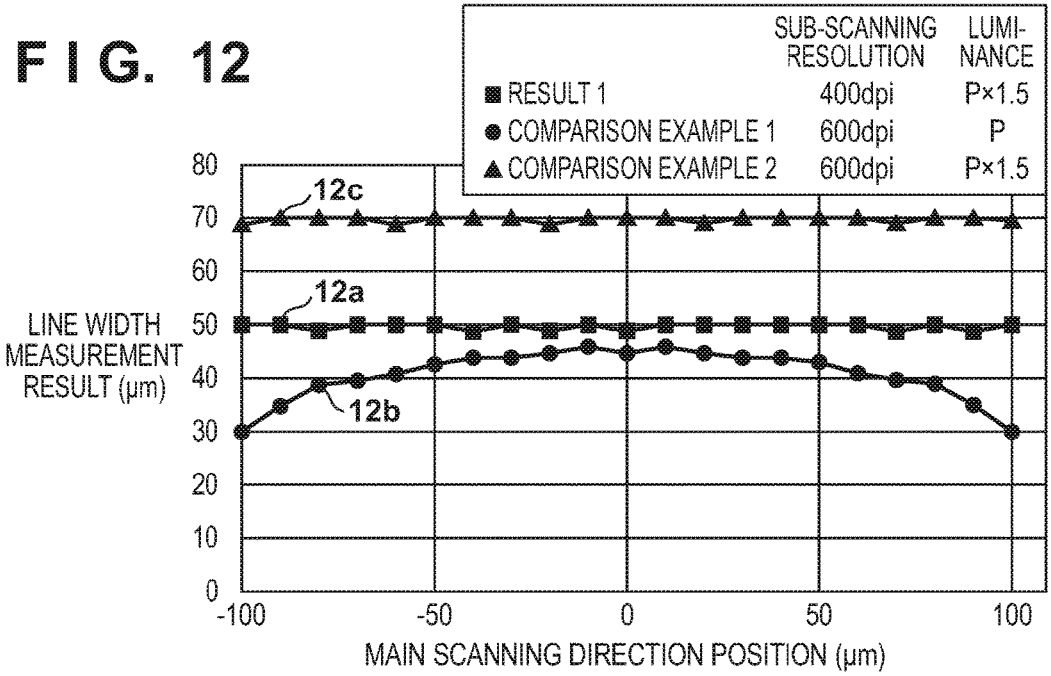
FIG. 12 is a graph showing line width measurement results according to the first embodiment.

FIG. 12 shows the line width measurement result obtained when a vertical line image of 1×200 dots is printed in each main scanning direction position.

The line width here corresponds to the length of one dot (one pixel) in the main scanning direction. In FIG. 12, the ordinate indicates the line width measurement result [μm], and the abscissa indicates the main scanning direction position [μm]. ScanMate F10 was used as the measurement device. In addition to result 1 according to this embodiment, line width measurement results of comparison example 1 and comparison example 2 will be shown in the same manner as comparison examples. In FIG. 12, a line graph 12*a* shows the line width measurement result of the result 1 of the first embodiment. In FIG. 12, a line graph 12*b* shows the line width measurement result of the comparison example 1. In FIG. 12, a line graph 12*c* indicates the line width measurement result of the comparison example 2.

The arrangements and the respective line width evaluation results of the arrangements are shown in table 1 hereinafter. Each arrangement has a different combination of the drum surface light amount per unit area, luminance, and resolution in the sub-scanning direction. The drum surface light amount per unit area of the result 1 according to this embodiment and that of the comparison example 1 each are 0.3 μJ/cm2. On the other hand, in the comparison example 2, the drum surface light amount per unit area is 0.45 J/cm2.

In a case in which the luminance of the comparison example 1 is set to P, the luminance of the result 1 according to this embodiment and that of the comparison example 2 will be set to P×1.5, which is 1.5 times the luminance P. Also, although the resolution in the sub-scanning direction of the comparison example 1 and that of the comparison example 2 each are 600 dpi, the resolution in the sub-scanning direction of the result 1 according to this embodiment is 400 dpi. Note that although the following description will exemplify a resolution of 600 dpi and 400 dpi, the present invention is not limited to this.

Here, the rotation speed of the deflector 405 is the same for a case in which the resolution in the sub-scanning direction is 600 dpi and that in the case in which the resolution in the sub-scanning direction is 400 dpi. On the other hand, the process speed, that is, the rotation speed of the photosensitive member 4 is 1.5 times of the case in which the resolution in the sub-scanning direction is 600 dpi in the case of 400 dpi. Hence, the drum surface light amount is equal between the result 1 according to this embodiment and the comparison example 1.

TABLE 1

| | Result 1 | Comparison Example 1 | Comparison Example 2 |
|---|---|---|---|
| Luminance (center) | P × 1.5 | P | P × 1.5 |
| Resolution in Main Scanning Direction | 600 dpi | 600 dpi | 600 dpi |
| Resolution in Sub-Scanning Direction | 400 dpi | 600 dpi | 600 dpi |
| Drum Surface Light Amount (μJ/cm2) | 0.3 | 0.3 | 0.45 |
| Line Uniformity | uniform | small end portion | uniform |
| Line Width | appropriate | small | too large |

As shown by the line graph 12*b* of FIG. 12, in the arrangement of the comparison example 1, the line width of the most off-axis image height is smaller than the line width of the on-axis image height. This is because the developing width of the most off-axis image height becomes smaller than the developing width of the on-axis image height as shown by the potential profile of the 1×3 dot image of FIG. 11A.

On the other hand, as shown by the line graph 12*c* of FIG. 12, in the arrangement of the comparison example 2, the line widths are almost the same for the respective image heights. This is because the developing widths are almost the same for the on-axis image height and the most off-axis image height as shown by the potential profile of the 1×3 dot image of FIG. 11B. However, although the line width will become uniform regardless of the image height in the case of the comparison example 2, it is not suitable as a line image since the line width itself will become larger than an appropriate value. In such an arrangement, for example, a problem in which a hollow portion of a hollow character formed from one dot becomes unclear when such a character is printed can occur.

On the other hand, by using the arrangement according to this embodiment, line uniformity can be maintained while setting the line width at an appropriate value as shown by the line graph 12*a* of FIG. 12. This is because, in addition to making the line width uniform regardless of the image height by setting the luminance to be P×1.5 and the resolution in the sub-scanning direction to be 400 dpi, the arrangement suppresses the line width itself from becoming larger than the appropriate value.

As described above, in this embodiment, even in a case in which an optical scanning device in which the spot diameter differs in accordance with the image height is used, the resolution in the sub-scanning direction is adjusted to be lower than that in the main scanning direction upon adjusting the luminance so that the line width will be almost equal between the center and each end portion. As a result, it is possible to suppress the line width from changing in accordance with its position in the main scanning direction and set an appropriate line width.

<Second Embodiment>

In the first embodiment, the PWM value was controlled in the manner shown in FIG. 7 in accordance with the input image data. In contrast, in the second embodiment, for example, letting PWM be the PWM value used in the first embodiment, a PWM value is controlled to be PWM×400 dpi/600 dpi=PWM×2/3. For example, the second embodiment is different from the first embodiment in the point that while "255" is the PWM value at the highest image tone (that is, level 31) in the pulse signal table according to the first embodiment, "170" is the PWM value at level 31 according to the second embodiment.

In this embodiment, emission and non-emission are repeated at a constant ratio for each pixel. More specifically, based on the above-described control contents, emission and non-emission are repeated for each pixel at the ratio of emission time: non-emission time=
170: (255−170)=2:1

As a result, an amount of light of for one pixel at the highest image tone will be a value corresponding to "170". Note that in one pixel, either the non-emission operation or the emission operation may be performed first.

Also, this embodiment also differs from the first embodiment in that, while the image resolution in the sub-scanning direction according to the first embodiment is 400 dpi, the image resolution in the sub-scanning direction according to this embodiment is 600 dpi. In addition, the image resolution in the main scanning direction is 600 dpi. The laser luminance is also P×1.5 in this embodiment similarly to the first embodiment. Other arrangements of this embodiment are the same as the first embodiment, and a detailed description will be omitted.

In a case in which the image resolution in the sub-scanning direction and the image resolution in the main scanning direction are the same, the arrangement according to this embodiment can suppress the line width from changing in accordance with its position in the main scanning direction as well as set an appropriate line width in the same manner as the first embodiment. More specifically, the arrangement according to this embodiment can suppress the problem in which the line width itself becomes larger than an appropriate value as described in the comparison example 2 of FIG. 12 of the first embodiment.

Figure 14:
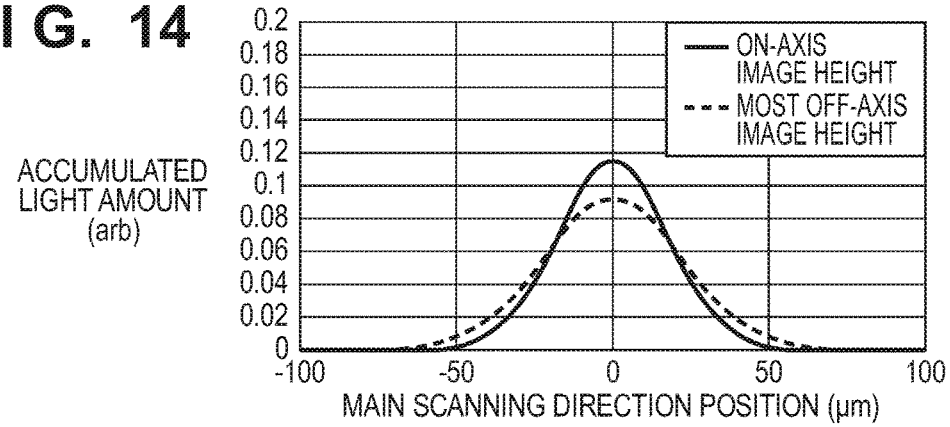
FIG. 14 is a graph showing an example of an accumulated light amount profile according to the second embodiment.

The reason for the above-description will be described hereinafter. FIG. 14 shows an accumulated light amount profile according to this embodiment of a 1×3 dot image on an axis b shown by a dot image 1302 in FIG. 13. In FIG. 14, the ordinate indicates an accumulated light amount [arb], and the abscissa indicates a main scanning direction position [μm]. On the other hand, the accumulated light amount profile shown in FIG. 9B is the accumulated light amount profile of the comparison example 2. The accumulated light amount profile of FIG. 14 according to this embodiment and the accumulated light amount profile of the comparison example 2 shown in FIG. 9B both show cases in which a sub-scanning resolution is 600 dpi, and the luminance is P×1.5. Compared to the accumulated light amount profile of FIG. 9B, the accumulated light amount profile of FIG. 14 has a smaller peak value and tails having a smaller distance therebetween. The PWM value is "255" in FIG. 9B, and a still spot light amount profile of about 42.3 μm is accumulated in the main scanning direction. In contrast, the PWM value is "170" in the case of this embodiment, and a still spot light amount profile of about 28.2 μm is accumulated in the main scanning direction. Hence, the profile becomes as that shown in FIG. 14.

Figure 15:
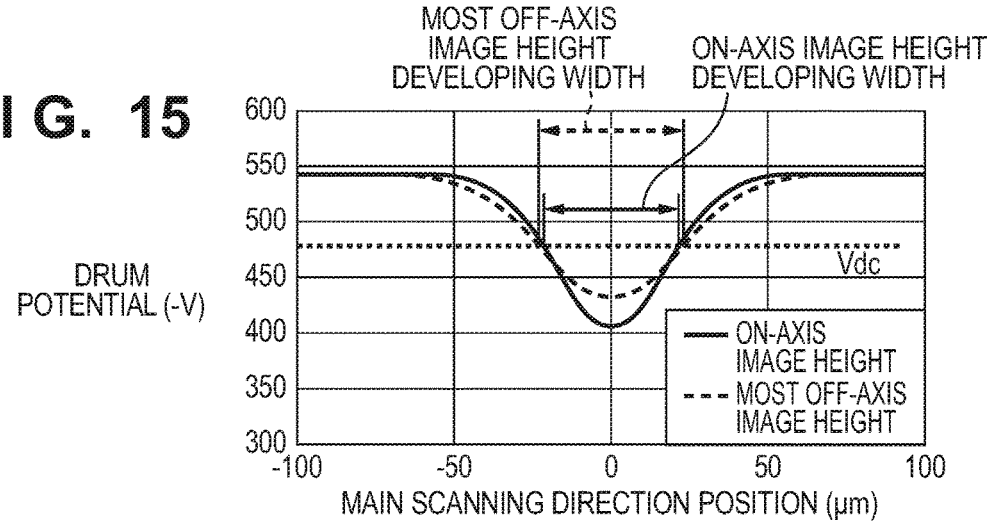
FIG. 15 is a graph showing an example of a potential profile according to the second embodiment.

FIG. 15 shows a potential profile according to this embodiment of the 1×3 dot image on the axis b shown by the dot image 1302 in FIG. 13. In FIG. 15, the ordinate indicates a drum potential [−V], and the abscissa indicates a position [μm] in the main scanning direction. On the other hand, the potential profile shown in FIG. 11B is the potential profile of the comparison example 2. The potential profile of FIG. 15 according to this embodiment and the potential profile of the comparison example 2 shown in FIG. 11B both show cases in which the sub-scanning resolution is 600 dpi, and the luminance is P×1.5. Compared to the potential profile of FIG. 11B, the potential profile of FIG. 15 has a smaller peak value and tails having a smaller distance therebetween.

Figure 16:
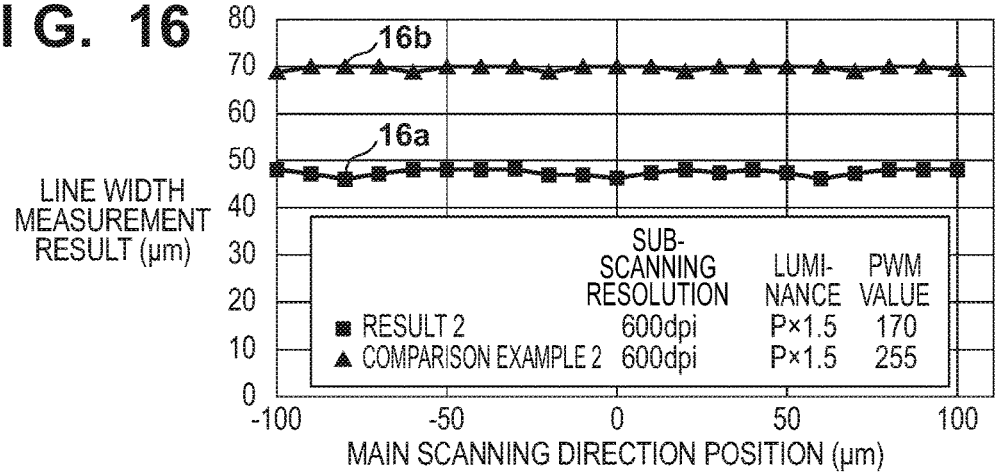
FIG. 16 is a view showing line width measurement results according to the second embodiment.

FIG. 16 shows line width measurement results according to this embodiment. In FIG. 16, a line graph 16*a* indicates the line width measurement result of result 2 according to this embodiment. In FIG. 16, a line graph 16*b* shows a line width measurement result of the comparison example 2. As described above, the result 2 according to this embodiment and the comparison example 2 both show cases in which the main scanning resolution and the sub-scanning resolution each are 600 dpi, and the luminance is P×1.5.

As shown in FIG. 16, it is possible to prevent the line width from changing in accordance with its position in the main scanning direction, and set an appropriate line width by the arrangement of this embodiment. This is apparent from the potential profile shown in FIG. 15.

<Third Embodiment>

An embodiment which has a function that switches a PWM value in accordance with an image resolution in a sub-scanning direction will be described as the third embodiment. That is, an image forming apparatus has an arrangement in which it is possible to perform image forming by a plurality of modes that switches the image resolution in the sub-scanning direction and is capable of switching the PWM value at the time of the switching. Note a detailed description of the same components as those in the first and second embodiments will be omitted.

[Processing Procedure]

Figure 17:
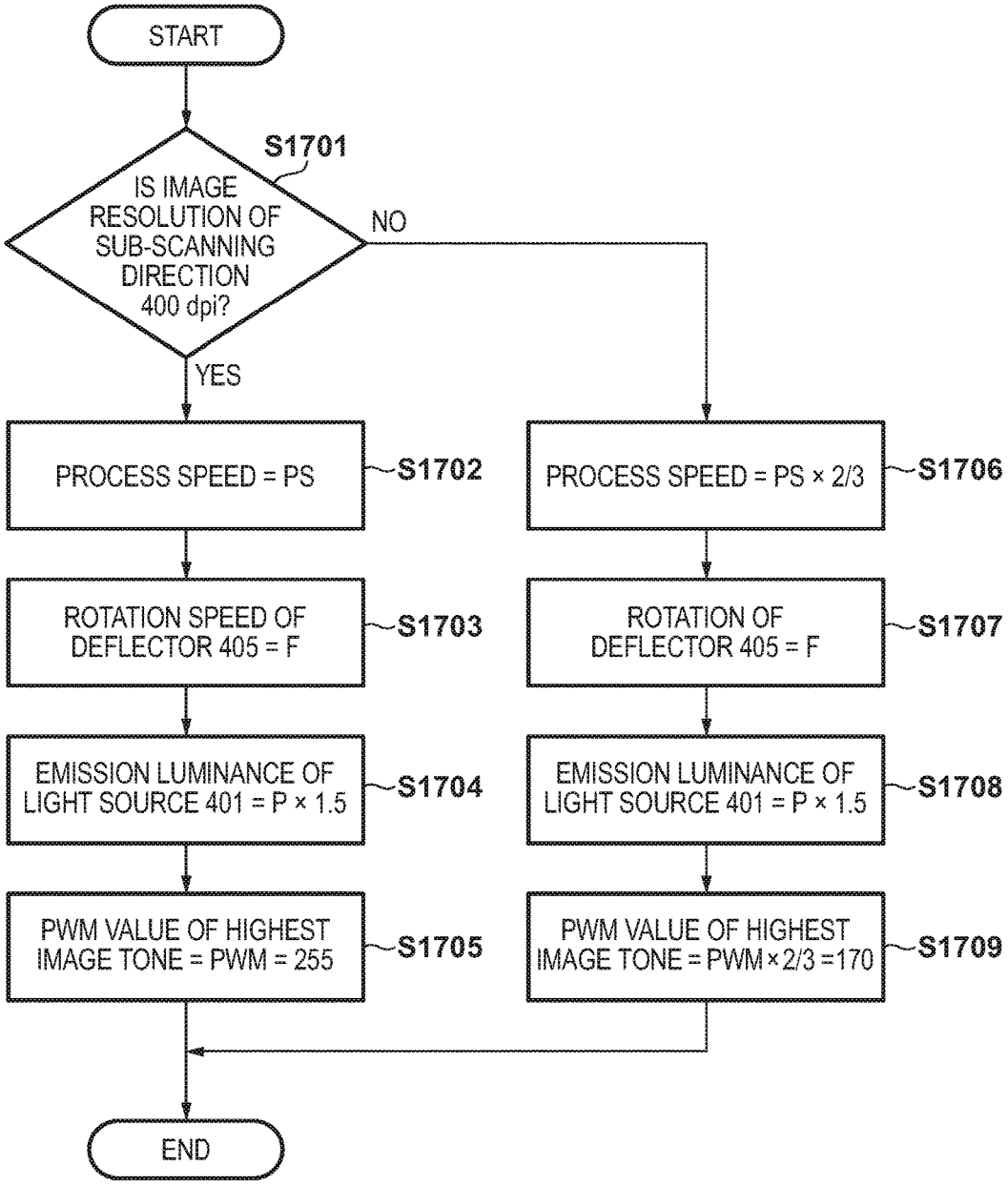
FIG. 17 is a flowchart of processing according to the third embodiment.

FIG. 17 is a flowchart showing PWM value switching processing according to this embodiment. Since this processing procedure is cooperatively controlled by a plurality of processing units, an image forming apparatus 9 will be described as the main processing entity here.

Upon acquiring image resolution information in the sub-scanning direction from a user via a printer driver (not shown), the image forming apparatus 9 sets a process speed corresponding to the image resolution information in the sub-scanning direction and causes the image forming apparatus to operate. A description will be made here by assuming that one of the values of 400 dpi and 600 dpi has been designated as the image resolution in the sub-scanning direction. Note that a process speed PS, a rotation speed F of a deflector 405, and a luminance P have been predetermined, and the respective pieces of information are held in the image forming apparatus 9.

In step S1701, the image forming apparatus 9 determines whether the designated image resolution in the sub-scanning direction is 400 dpi. If 400 dpi has been designated (YES in step S1701), the process advances to step S1702. If 600 dpi has been designated (NO in step S1701), the process advances to step S1706.

In step S1702, the image forming apparatus 9 sets the process speed to PS. More specifically, the rotation speed of a photosensitive member 4 is set to 120 mm/s.

In step S1703, the image forming apparatus 9 controls a driving unit (not shown) so as to make the rotation speed of the deflector 405 converge to the constant rotation speed F regardless of the image resolution information in the sub-scanning direction.

In step S1704, the image forming apparatus 9 performs control so that the emission luminance of a light source 401 will be luminance P×1.5 (=600/400) regardless of the image resolution information in the sub-scanning direction.

In step S1705, the image forming apparatus 9 sets the PWM value of the highest image tone to 255. In accordance with this, the image forming apparatus sets the PWM value of each tone of the image. That is, the image forming apparatus makes settings so as to set an arrangement shown with reference to FIG. 7 in the first embodiment. Subsequently, the main processing procedure ends.

In step S1706, the image forming apparatus 9 sets the process speed to (PS×400/600). More specifically, the image forming apparatus sets the rotation speed of the photosensitive member 4 to 80 mm/s.

In step S1707, the image forming apparatus 9 controls the driving unit (not shown) so as to make the rotation speed of the deflector 405 converge to the constant rotation speed F regardless of the image resolution information in the sub-scanning direction.

In step S1708, the image forming apparatus 9 performs control so that the emission luminance of the light source 401 will be luminance P×1.5 (=600/400) regardless of the image resolution information in the sub-scanning direction.

In step S1709, the image forming apparatus 9 performs control so that the PWM value of the highest image tone will be 170 (=255×400/600). In accordance with this, the image forming apparatus performs control so that the PWM value of each tone of the image will be a value weighted by ⅔. That is, image forming apparatus makes settings so as to set an arrangement described in the second embodiment. Subsequently, the main processing procedure ends.

As described above, the arrangement of this embodiment can set an appropriate line width in addition to suppressing the line width from changing in accordance with its position in the main scanning direction regardless of the resolution in the sub-scanning direction.

Note that although the above-described arrangement described an example in which 600 dpi and 400 dpi were set as the resolution in the main scanning direction and as the resolution in the sub-scanning direction, the combination of the resolutions is not limited to this, and it may be another arrangement. In addition, the relationship between each image height and partial magnification shown in FIG. 3 is merely an example, and it suffices for information which is to be used for various kinds of control to be defined in accordance with the changes of this relationship. For example, consider a case in which the resolution in the sub-scanning direction is A dpi and a case in which the resolution in the sub-scanning direction is B (>A) dpi. In this case, if the PWM value in the case of A is set to "255", and control is performed so as to set the PWM value in the case of B to "255×(A/B)". In this case, the ratio of laser light emission and non-emission at a given scanning position will be 255×(A/B):{255−(255×(A/B))}=(A/B):{1−(A/B)}. The luminance P of the laser light will be controlled to be (B/A).

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-006691, filed Jan. 18, 2018, which is hereby incorporated by reference herein in its entirety.

What is claimed is:

1. An image forming apparatus comprising:
a photosensitive member;
a charger unit configured to charge the photosensitive member;
an exposing unit configured to form a latent image by scanning the photosensitive member by laser light which has a different spot diameter in accordance with a scanning position of the photosensitive member in a main scanning direction;
a developing unit configured to develop an image by adhering a toner to the photosensitive member on which the latent image is formed; and
a control unit configured to control a luminance of the laser light and a resolution of the photosensitive member in a sub-scanning direction in accordance with the scanning position of the photosensitive member in the main scanning direction.

2. The apparatus according to claim 1, wherein the control unit controls the luminance of the laser light and the resolution in the sub-scanning direction of the photosensitive member so that a width of a pixel in each scanning position of the photosensitive member in the main scanning direction will be uniform.

3. The apparatus according to claim 1, wherein the control unit controls an exposure time of the laser light of the exposing unit so that a width of a dot corresponding to a pixel in each scanning position of the photosensitive member in the main scanning direction will be uniform.

4. The apparatus according to claim 1, wherein the control unit performs control so that a second exposure time of the laser light of the exposing unit, with respect to a second scanning position nearer to a center of the photosensitive member than a first scanning position in the main scanning direction, will be shorter than a first exposure time of the laser light of the exposing unit, with respect to the first scanning position in the main scanning direction.

5. The apparatus according to claim 1, wherein the control unit performs control so that a second luminance of the laser light of the exposing unit with respect to a second scanning position nearer to a center of the photosensitive member than a first scanning position in the main scanning direction will become lower than a first luminance of the laser light of the exposing unit with respect to the first scanning position in the main scanning direction.

6. The apparatus according to claim 5, wherein the control unit performs control so that the second luminance with respect to the second scanning position in the main scanning direction will become lower than the first luminance with respect to the first position in the main scanning direction by APC (Auto Power Control) and by using pre-held information.

7. The apparatus according to claim 1, wherein the control unit performs control so that the resolution in the sub-scanning direction of the photosensitive member will become lower than a resolution in the main scanning direction.

8. The apparatus according to claim 1, wherein the image forming apparatus is capable of performing image formation in a plurality of modes by switching the resolution of the photosensitive member in the sub-scanning direction, and in a case in which A is a resolution in the sub-scanning direction of a first mode and B (>A) is a resolution in the sub-scanning direction of a second mode, and PS is a process speed of the first mode, PS×A/B is set as a process speed of the second mode, and in the second mode, the exposure of the laser light is controlled so that an amount of light in each scanning position of the photosensitive member in the main scanning direction will correspond to a value obtained by weighting a corresponding image data value with (A/B).

9. The apparatus according to claim 8, wherein the control unit controls the amount of light in each scanning position by repeating emission and non-emission at an interval based on a ratio of A/B:{1−(A/B)} for each pixel of the photosensitive member in the main scanning direction.

10. The apparatus according to claim 8, wherein in a case in which P is a luminance of the laser light set in advance, the control unit controls the luminance of the laser light to be P×B/A in one of the first mode and the second mode.

11. The apparatus according to claim 1, wherein a first scanning speed of the laser light at a first scanning position in the main scanning direction is faster than a second scanning speed of the laser light at a second scanning position that is closer to a center of the photosensitive member than the first scanning position in the main scanning direction.

12. An image forming apparatus comprising:

a photosensitive member;

a charger unit configured to charge the photosensitive member;

an exposing unit configured to form a latent image by scanning the photosensitive member by laser light which has a different spot diameter in accordance with a scanning position of the photosensitive member in a main scanning direction;

a developing unit configured to develop an image by adhering a toner to the photosensitive member on which the latent image is formed; and a control unit configured to control a luminance of the laser light and an emission time of the laser light for each pixel position of the photosensitive member in the main scanning direction.

13. The apparatus according to claim 12, wherein the control unit controls the emission time of the laser light so that an amount of light in each scanning position of the photosensitive member in the main scanning direction will correspond to a value obtained by weighting a corresponding image data value with a predetermined ratio.

14. The apparatus according to claim 13, wherein the control unit controls the amount of light in each scanning position by repeating emission and non-emission at an interval based on the predetermined ratio for each pixel of the photosensitive member in the main scanning direction.

15. The apparatus according to claim 12, wherein a first scanning speed of the laser light at a first scanning position in the main scanning direction is faster than a second scanning speed of the laser light at a second scanning position that is closer to a center of the photosensitive member than the first scanning position in the main scanning position.

16. A control method of an image forming apparatus that includes a photosensitive member, a charger unit configured to charge the photosensitive member, an exposing unit configured to form a latent image by scanning the photosensitive member by laser light which has a different spot diameter in accordance with a scanning position of the photosensitive member in a main scanning direction, and a developing unit configured to develop an image by adhering a toner to the photosensitive member on which the latent image is formed, the method comprising:

controlling a luminance of the laser light and a resolution of the photosensitive member in a sub-scanning direction in accordance with the scanning position of the photosensitive member in the main scanning direction.

17. A control method of an image forming apparatus that includes a photosensitive member, a charger unit configured to charge the photosensitive member, an exposing unit configured to form a latent image by scanning the photosensitive member by laser light which has a different spot diameter in accordance with a scanning position of the photosensitive member in a main scanning direction, and a developing unit configured to develop an image by adhering a toner to the photosensitive member on which the latent image is formed, the method comprising:

controlling a luminance of the laser light and an emission time of the laser light for each pixel position of the photosensitive member in the main scanning direction.

* * * * *